United States Patent [19]

Grimes et al.

[11] Patent Number: 4,993,141

[45] Date of Patent: Feb. 19, 1991

[54] METHOD OF MAKING TRANSFORMERS AND CORES FOR TRANSFORMERS

[75] Inventors: Frank H. Grimes; Eugenius S. Hammack, both of Athens, Ga.

[73] Assignee: ABB Power T&D Co., Inc., Blue Bell, Pa.

[21] Appl. No.: 382,150

[22] Filed: Jul. 19, 1989

[51] Int. Cl.[5] ..... H01F 7/06

[52] U.S. Cl. ..... 29/606; 29/609; 336/213; 336/217

[58] Field of Search ..... 29/609, 606; 336/213, 336/216, 217

[56] References Cited

U.S. PATENT DOCUMENTS

| | | | |
|---|---|---|---|
| 2,477,350 | 7/1949 | Somerville | 29/606 |
| 2,960,756 | 11/1960 | Treanor | 29/606 |
| 4,709,471 | 12/1987 | Valencic et al. | 29/605 |
| 4,741,096 | 5/1988 | Lee et al. | 29/605 |
| 4,761,630 | 8/1988 | Grimes et al. | 336/213 |

*Primary Examiner*—P. W. Echols

*Attorney, Agent, or Firm*—Hymen Diamond

[57] ABSTRACT

A method of making a product for use in fabricating a low-loss core of a transformer. The core is composed of a web of amorphous metal of small thickness. In forming the product, the web is wound into an annular spiral structure on a circularly cylindrical mandrel. The structure is removed from the mandrel and collapsed into an approximate figure "8" shape and groups of cuts are produced in the upper collapsed surface of the figure "8". Each cut defines a step of a group. Each step has a number of turns of the web and each group has a number of steps. The steps of each group are offset in a succession along the structure and penetrates progressively into the structure. Successive groups extend progressively inwardly throughout the structure. The cuts subdivide the structure into separate strips. The strips are wrapped in a spiral to form a lapped spiral structure onto a second circularly cylindrical mandrel of smaller diameter than the first mandrel. In wrapping the steps of each group, the ends of each step are lapped and the inner end of each step forms a butt joint with the outer end of the immediately preceding inner step.

14 Claims, 11 Drawing Sheets

METHOD OF MAKING TRANSFORMERS AND CORES FOR TRANSFORMERS

BACKGROUND OF THE INVENTION

This invention relates to the transformer art, and it has particular relationship to transformers whose cores are composed of laminations of amorphous magnetizable material of small thickness. Typically, the thickness of the laminations is about 0.001-inch. This invention is uniquely advantageous for transformers whose cores are composed of wound webs of small thickness of amorphous magnetizable material and is disclosed herein in detail as applied to such transformers and cores. It is to be understood however, that the adaptation of the principles of this invention to transformers and cores composed of magnetizable materials of other types, for example, highly grain-oriented silicon iron, is within the scope of equivalents of this application and of any patent which may issue on, or as a result thereof, typically as scope of equivalents is applied in Grover Tank & Mfg. Co. v. Linde Air Products Co., 339 US 605; 70 Supreme Court Reporter 854 (1950) and interpreted in Uniroyal v. Rudkin-Wiley Corp., 5 USPQ 2d 1434 (CAFC 1988).

This invention concerns itself with transformers which are assembled with preformed coils which are telescoped on the legs of the core. To assemble such a transformer, it is necessary that the core, after being wound, be severed in a region and opened, to permit the telescoping of the coils, and thereafter reclosed. There are air gaps in the core of the completed transformer in the regions where the core is severed, increasing the magnetic reluctance which it is desirable to minimize.

U.S. Pat. No. 4,761,630, Frank H. Grimes and Eugenius S. Hammack, discloses a core with step-lap-butt joints in the regions of the cuts. In Grimes, the cuts are in staggered groups, each group including a plurality of peripherally offset steps which penetrate progressively inwardly into the core. In FIG. 3 of Grimes the steps are cut into the spiral, i.e., in the direction in which the spiral forming the core is wound, and the turn which bounds the inner end of an outer step and the outer end of the immediately adjacent inner step is overlapped. In FIG. 4 of Grimes the steps are cut out of the spiral, i.e., opposite to the direction in which the spiral is wound, and the overlap is between the last turn (8 or 7) of an outer step and the first separate turn (1) of the immediately adjacent inner step. There is also an overlap between the turn (7) which bounds the inner end of the last step of an outer group and the immediately adjacent inner step of an inner group. Effective reduction in reluctance was achieved in transformers embodying the Grimes invention. However, it is desirable to reduce the reluctance still further and it is an object of this invention to achieve this purpose.

In addition to Grimes, U.S. Pat. No. 4,741,096 Lee-Ballard is typical of the prior art. Lee discloses a transformer whose core is formed by winding a strip of ferromagnetic material on a first cylindrical mandrel, into an annulus, producing a radial cut through the annulus in one region, opening the annulus, winding the opened structure on a second mandrel having a diameter smaller than the first mandrel, and rearranging the laminations into what Lee calls "groups" which Lee says forms "packets" so that the "groups" overlap. Lee's teaching suffers the disadvantage that the cost of embodying it in a transformer is high. The rearrangement of the laminations on the second mandrel into "groups" and "packets" to produce the overlaps involves substantial cost. An important cost-factor is the necessity of counting the laminations of small thickness to subdivide them into "groups" and "packets" in rearranging the structure. In addition, it is desirable that the number of "groups" in Lee's "packet" be increased as the packets progress from the window of the core to its outer periphery. This involves the costly process of counting "groups" to effectuate the desired increase.

It is an object of this invention to overcome the disadvantages and drawbacks of prior art as taught by references such as Lee and to provide a relatively low-cost method of making a transformer having a core whose laminations or turns are overlapped to reduce magnetic reluctance. It is also an object of this invention to provide a method for providing a product for use in making a core for the transformer, made by the low-cost method.

SUMMARY OF THE INVENTION

This invention arises from the discovery and realization that the costly rearrangement which Lee's teaching demands can be eliminated by abandoning Lee's teaching to cut radially through the annulus wound on the mandrel of larger diameter. Instead, in accordance with this invention, the product from which the core is formed is made by using as an intermediate structure that disclosed in Grimes '630 (FIGS. 3 and 4) as a starting point and converting this intermediate structure into the final overlapped product. In practicing this invention, the web is wound into a spiral structure on a first mandrel of larger perimeter. Groups of steps are then cut into this spiral structure. The steps are cut as taught by U.S. Pat. No. 4,709,471 to Milan D. Valencic and Dennis A. Schaffer or in U.S. application Ser. No. 293,162, filed Jan. 3, 1989 to Frank H. Grimes and Eugenius S. Hammack, both incorporated herein by reference. Each step may include one but usually includes a number of turns of the web. In the practice of Valencic or Grimes '162, the intermediate structure is removed from the larger mandrel and collapsed into the shape approximately of a figure 8 as shown in FIGS. 4 through 9 of Valencic and FIG. 1 of Grimes '162. Starting with the outer surface of the structure stacks of turns of the structure, depending on the number of turns in each step, are raised, cut and folded back to afford access to cut the immediately inner step. Typically, the cuts are perpendicular to the turns; they may also be at an angle different from 90 ° to the turns. The steps of each group are offset peripherally along the structure and extend progressively into the depth of the structure. The groups are offset and extend in rows progressively into the depth of the structure over a surface of limited length peripherally of the structure as shown in FIGS. 3 and 4 of Grimes '630. Each group as in Grimes (not identified by a number or letter) includes a plurality of steps A, B, C for the upper group and D, E, F for the lower group, whose number may vary in the direction parallel to the cuts along the depth of the structure. Typically, there are a smaller number of steps per group inwardly than outwardly. An intermediate product is thus produced. The word "turns" as used in this application has the same meaning as "laminations" which is sometimes used in this application and in the transformer art to refer to the stacked sheets which make up a transformer core.

By cutting the steps, of the intermediate product separate aggregates of contiguous turns or laminations, which are called herein "strips" of turns or laminations are produced; each strip including a number of laminations and each strip being derived from a step in the spiral structure. In the further practice of this invention, these separate strips are wrapped around a second mandrel of smaller perimeter than the first mandrel used to make the intermediate product in the same order as the turns of which they are composed were wound on the first mandrel. The strips are wrapped on the mandrel of smaller perimeter fitting neatly together, like the parts of a three-dimensional jigsaw puzzle, with combinations of strips, including the inner and outer ends of the same strips, overlapping and the inner ends of each combination forming a butt joint with the outer end of the immediately inward step. Each butt joint is, in actual fact, a gap offering substatial resistance, to the flow of magnetic flux, which is considerably higher than the resistance through the interfaces between the turns which bound the joint. The expression "butt joint" is used in this application in line with the practice in the art as exemplified by Grimes '630. A "butt joint", as this term is used in the art, is a joint between confronting ends of separate turns of a core. As the expression "butt joint" is used in the art, the confronting ends need not be in contact. As the turns progress outwardly; the overlap between the steps decreases until it disappears and beyond this outward region, the structure is the same as the step-butt-lap structure disclosed in Grimes '630. Each inner step of a group terminates in the same turn of the spiral structure as the peripherally offset immediately succeeding radially outer step. After the strips are wrapped around or wound on the second mandrel to form the product, a core is produced from the product and a transformer including the core is produced. The final steps in forming the core and transformer are carried out by following the teachings of Valencic particularly with reference to FIGS. 11 through 22 of Valencic.

It is to be understood that a "step" in this application is analogous to a "group" in Lee and a "group" in this application is analogous to a "packet" in Lee. A step may include a number of turns, typically 7 to 30. It is also to be understood that the mandrels are described above with reference to their perimeters advisedly since the mandrels need not be circularly cylindrical in the practice of this invention. The word "spiral" does not mean a spiral produced by winding a web on a circular cylinder; the word means a structure of any transverse cross-section formed of contiguous stacked turns of a web.

In the use of a transformer made in accordance with this invention, the magnetic field produces forces in the interface between the contiguous laminations which causes them to adhere. The flux at each butt joint is diverted at their overlapping ends through the adhered laminations. Since each step includes a number of laminations, the tendency to saturate by reason of crowding of flux is reduced. The separated laminations wrapped on the mandrel of smaller perimeter fit neatly together.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which:

FIGS. 6A and 6B can also be viewed as a section enlarged of a view in end elevation of a portion of the yoke of the core shown in FIG. 7, in which the cuts progress into the spiral are overlapped and confront each other. FIGS. 5A and 5B can be viewed in like section enlarged of a view in end elevation of a portion of a yoke of a core similar to the one shown in FIG. 7, but with the cuts progressing out of the spiral.

DETAILED DESCRIPTION OF PRACTICE OF THIS INVENTION

Figure 1:
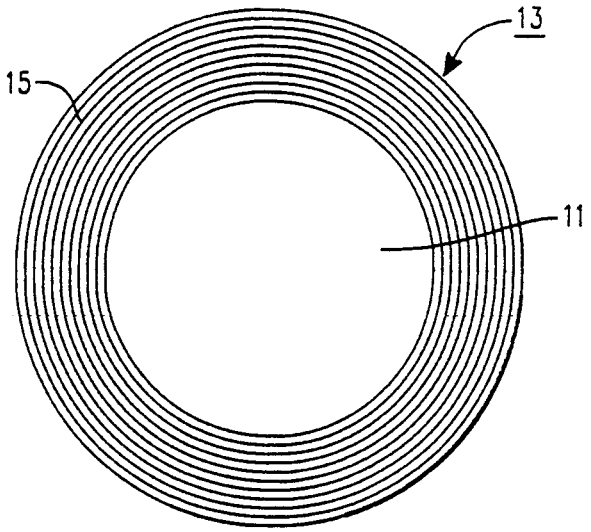
FIG. 1 is a view in end elevation, generally diagrammatic, showing a mandrel of larger perimeter used in the practice of the invention with the spiral structure of the magnetizable web wound thereon.
Figure 2A:
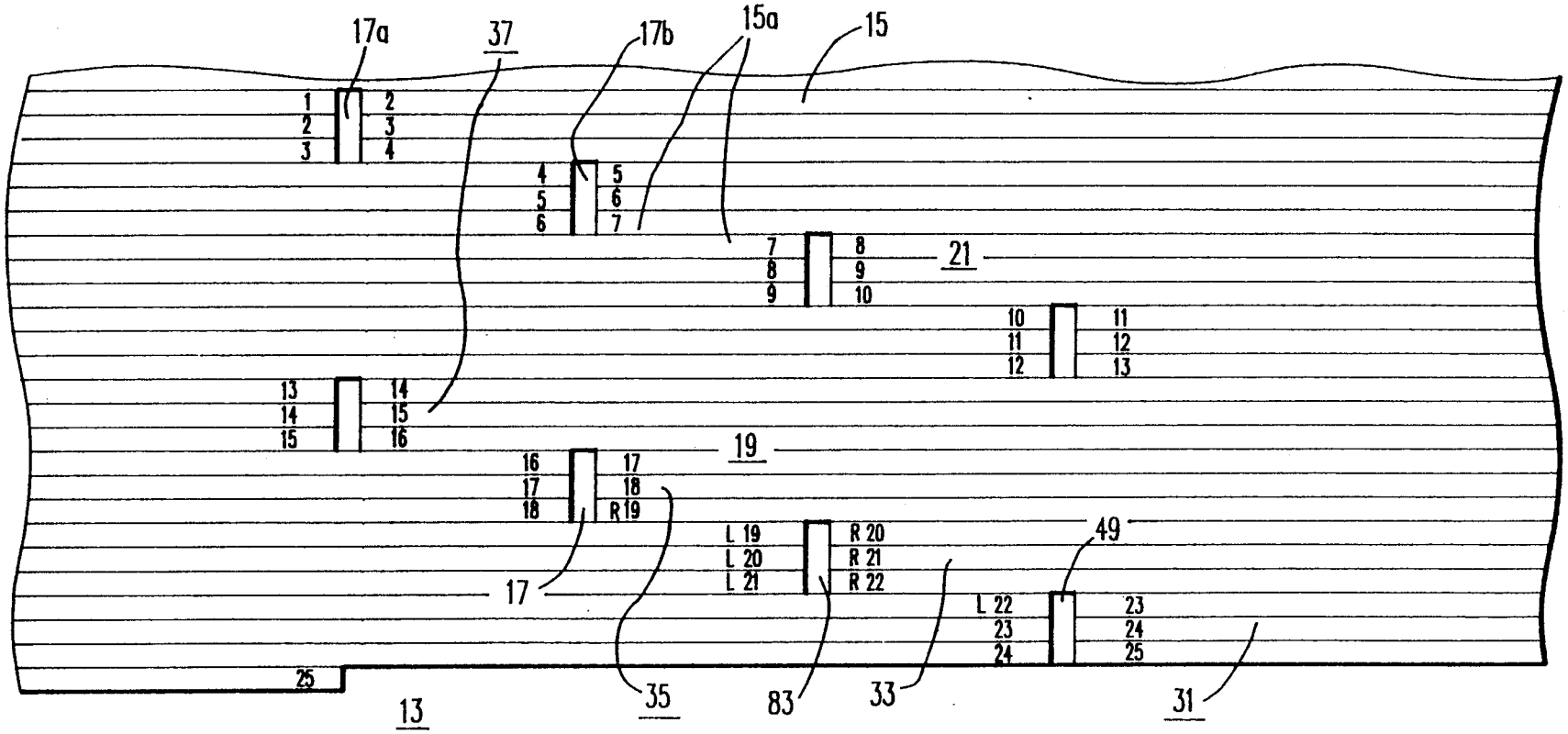
FIGS. 2A and 2B together constitute a diagrammatic view in end elevation, enlarged, of a portion of the spiral structure shown in FIG. 1 made in the practice of this invention with steps progressing into the spiral, i.e., in the direction in which the spiral structure is wound.
Figure 2B:
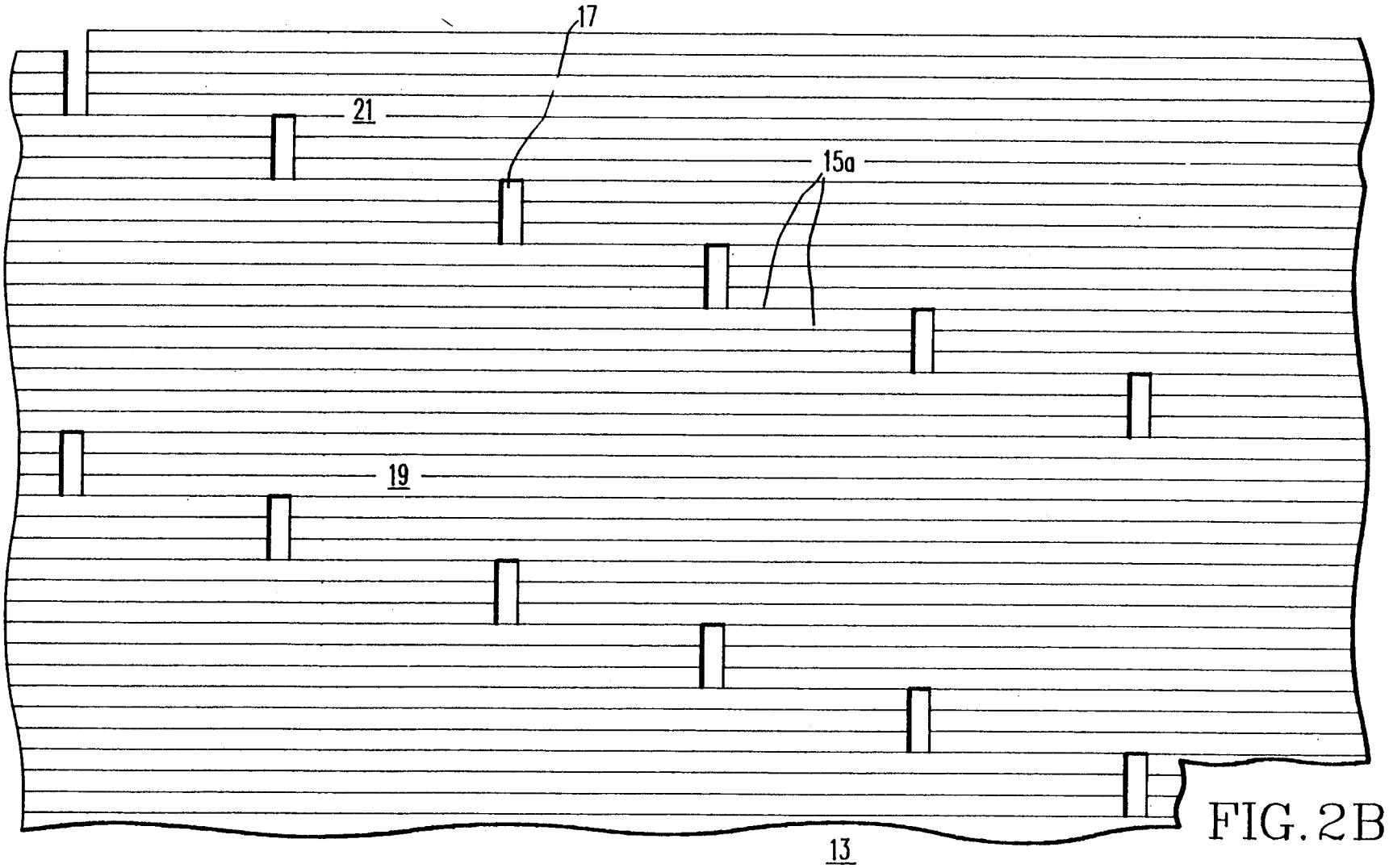

FIG. 1 shows a mandrel 11 on which is wound a tight spiral structure 13 formed of a web 15, typically of amorphous magnetizable material such as Allied Metglas Products amorphous metal alloys 2605 SC and 2605 S2. In the practice of this invention, cuts 17 in groups 19 of steps 21 (FIG. 2A) are cut in depth throughout the spiral surface from the outer surface of the spiral structure 13 to the inner surface. The structure with the cuts into the spiral is identified by 13I. The groups 19 are encompassed within a limited length peripherally of the spiral surface. To make the cuts, the spiral structure 13 is removed from the mandrel 11, collapsed into a shape approximately resembling a figure 8, and cut as disclosed in Valencic in connection with Valencic's FIG. 6 and related views or as taught by Grimes' application 290,162 in connection with FIG. 1. Each cut 17 in structure 13I penetrates through a number of turns of the spiral structure 13. A step 21 is defined by the number of turns cut. As shown in FIGS. 2A and 2B, there are three turns per step 21. Also, as shown in FIGS. 2A and 2B, as viewed from the upper step to the lower step, the steps progress in the direction of the spiral, i.e., into the spiral, clockwise as viewed in FIGS. 2A and 2B. The cuts 17 extend into the spiral structure 13, perpendicularly to the turns and are offset peripherally and in depth to form the steps 21. Also, as shown in FIGS. 2A and 2B, the number of steps 21 per group 19, nearer the inner surface of the structure, is smaller than the number of steps per group more remote from the inner surface, Typically, there is shown 4 steps, 21 per group 19, nearer the inner surface and 6 steps per group more remote from the inner surface. In the practice of this invention, there may be several groups with steps of a given number followed by several outward groups with steps of a higher number. In actual practice of this invention, the number of steps 21 in a group may be of the order of 7 to 15. As shown in FIGS. 2A and 2B, the inner cut 17 and the immediate outer cut defining a step terminates in the same turn 15*a*. In the structure 130 FIGS. 3A and 3B, the cuts 23 are shown progressing in the direction opposite to the direction in which the spiral structure 13 is wound, i.e., out of the spiral or counterclockwise as viewed in FIGS. 3A and 3B. The cuts 23 produce steps 26 which form groups 28.

To aid in the understanding of this invention, the turns which are severed by each cut are numbered. These numbers should not be confused with numbers identifying the apparatus. The uppermost cut 17*a* on the left of the outer group shown in FIG. 2A, severs turns 1, 2, 3 and the second cut 17*b* from the left cut severs turns 4, 5, 6. Turn 4 is common to cuts 17*a* and 17*b*.

Figure 6A:
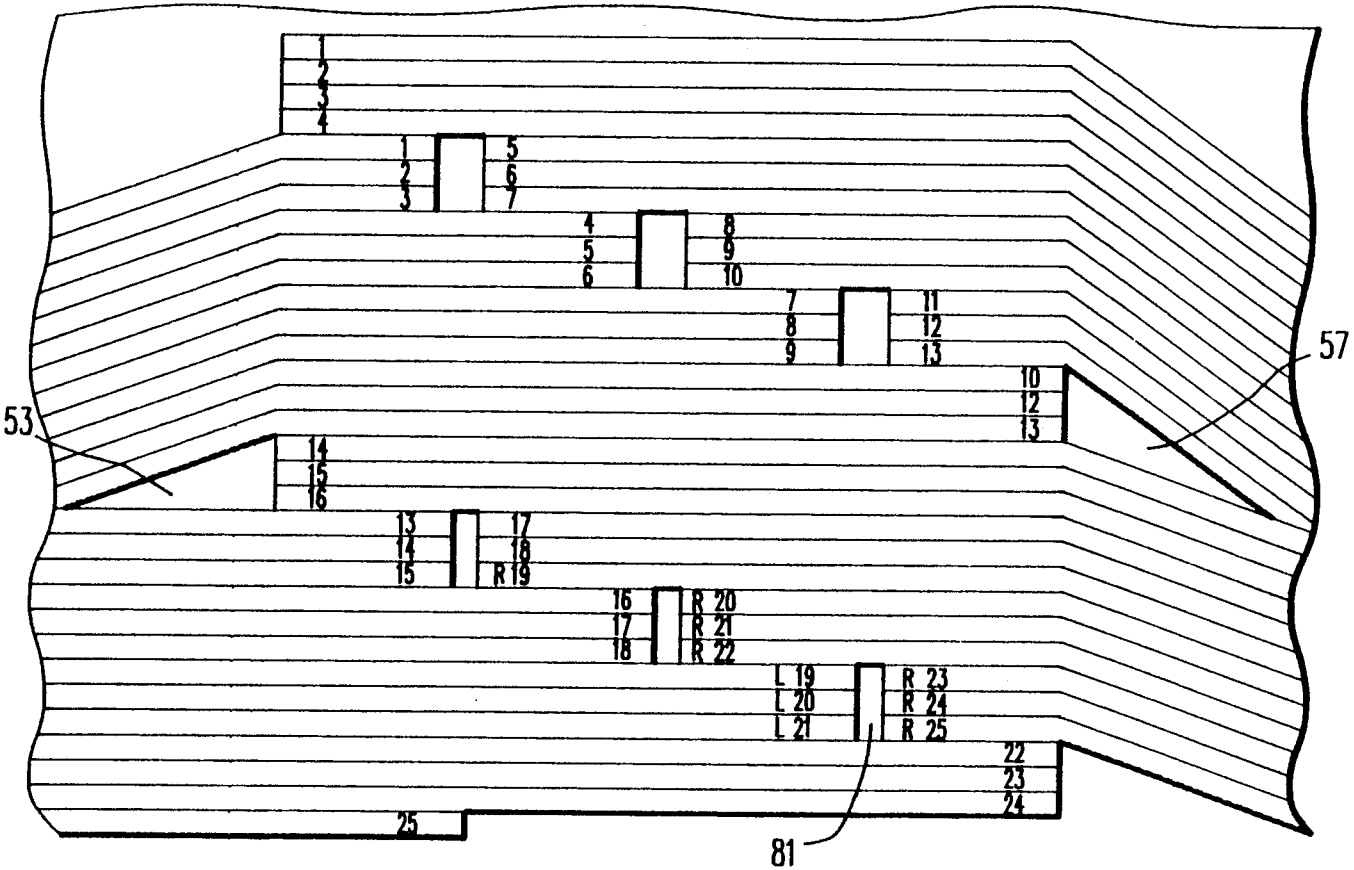
FIGS. 6A and 6B together constitute a diagrammatic view similar to FIGS. 5A and 5B, but with the steps progressing into the spiral.
Figure 6B:
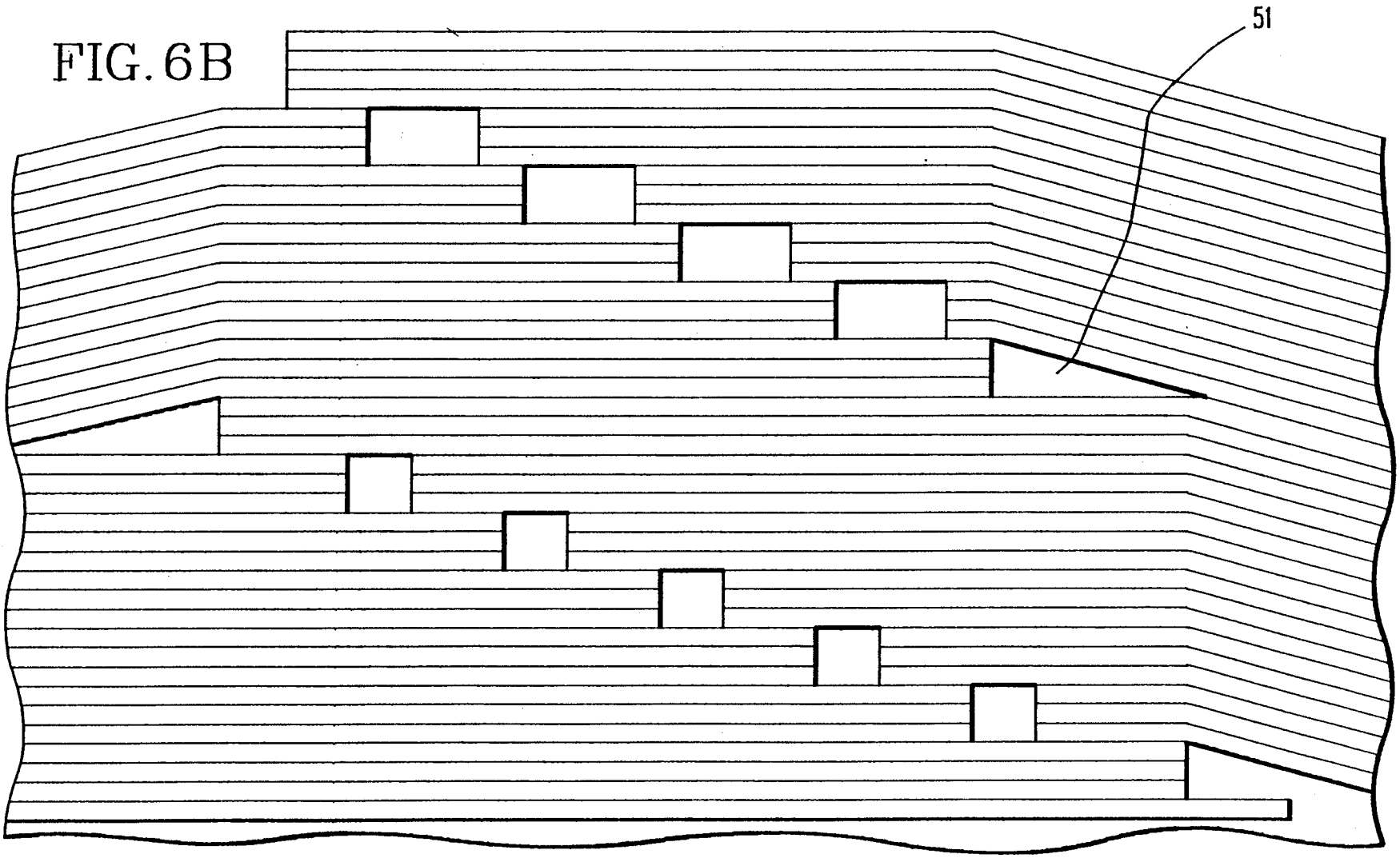
Figure 7:
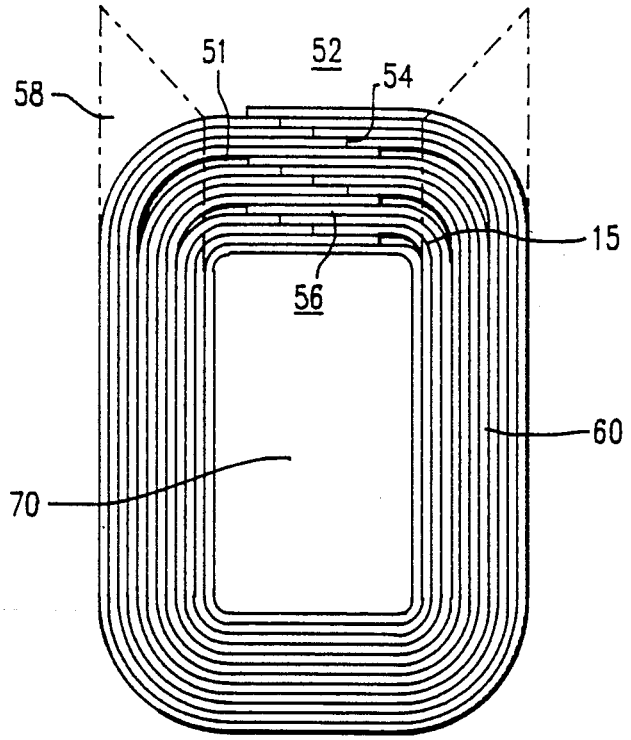
FIG. 7 is a view in end elevation, generally diagrammatic, showing a core in made accordance with this invention.
Figure 8:
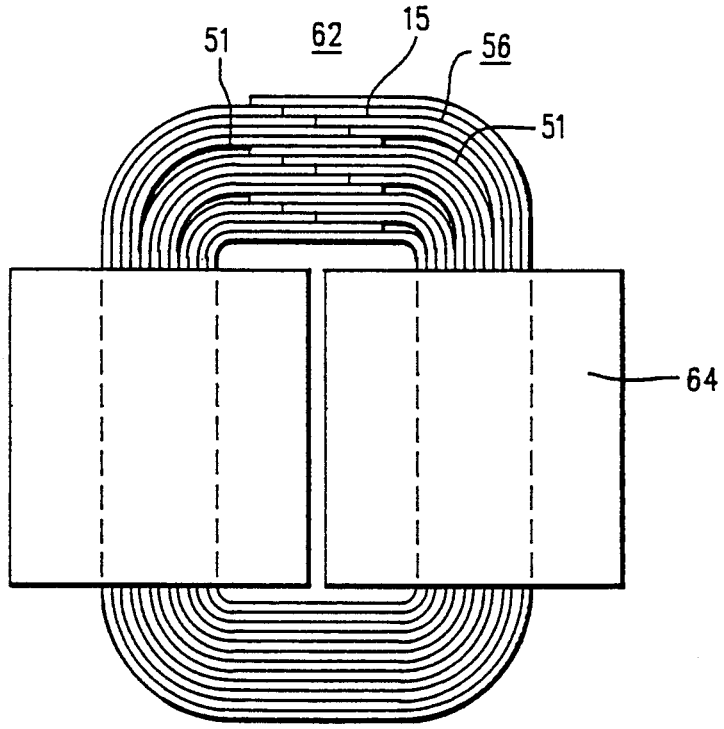
FIG. 8 is a view in end elevation, generally diagrammatic, showing a transformer made in accordance with this invention.

During the cutting operation, the spiral structure 13 is in the collapsed state which in end elevation resembles, generally, a figure 8 as shown in FIGS. 6 through 9 of Valencic or in FIG. 1 of Grimes '162. By the cuts 17, the spiral structure 13I is subdivided into separate strips, each including a plurality of stacked turns. For example, with reference to FIGS. 2A and 2B, strip 31 including the turns 23, 24, 25, the strip 33 including the turns 20, 21, 22, the strip 35 including the turns 17, 18, 19, and the strip 37 including the turns 14, 15, 16. The word "strip" or "strips" is used here to identify the steps of the spiral structure 13I or 130 or aggregates of turns or laminations which in the practice of this invention, are removed from mandrel 11 to distinguish between the steps on the intermediate structure and the aggregates of the turns of each step removed from the intermediate structure.

Figure 3A:
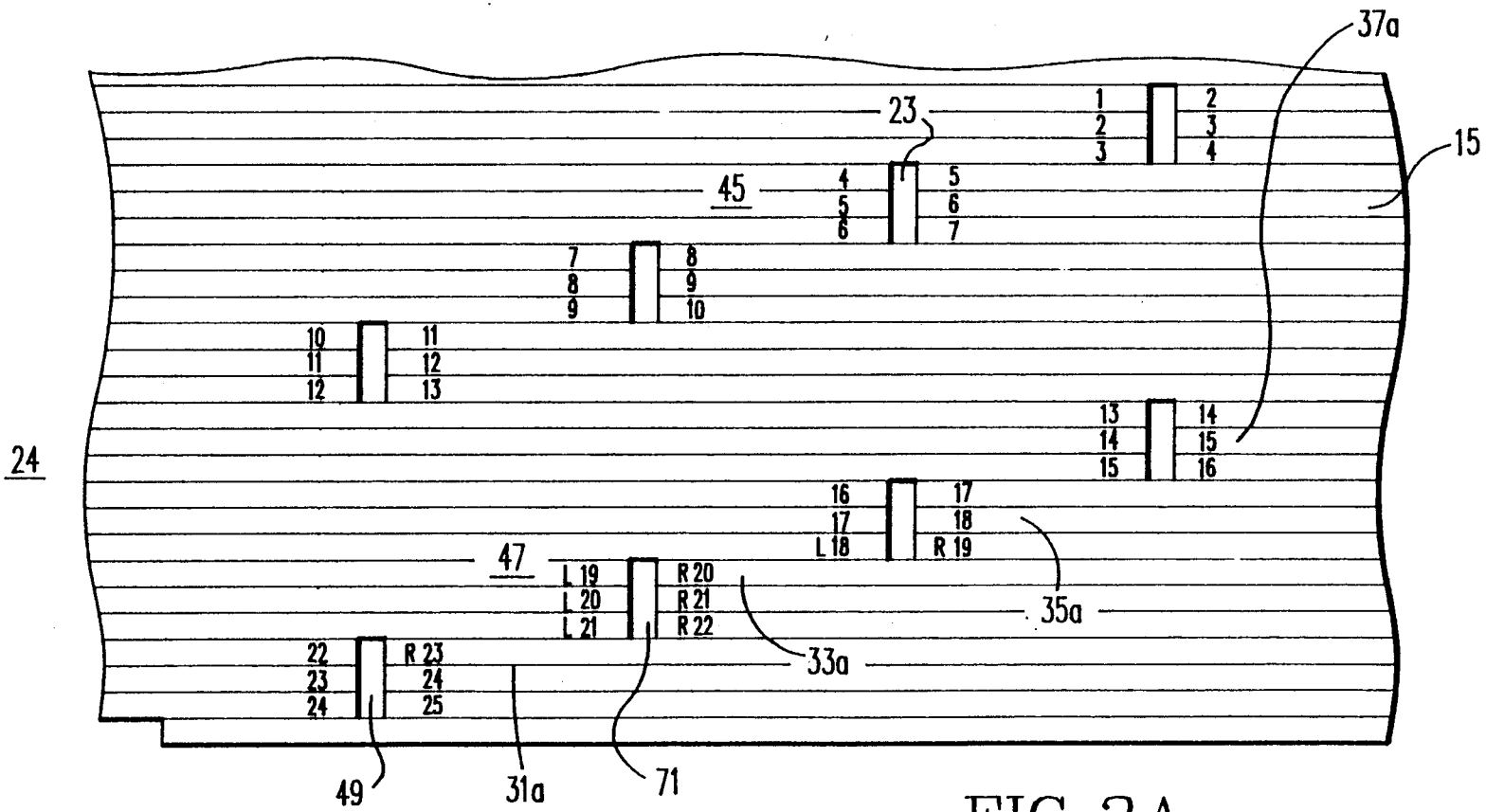
FIGS. 3A and 3B together constitute a diagrammatic view similar to FIGS. 2A and 2B showing the steps progressing out of the spiral, i.e., opposite to the direction in which the spiral is wound.
Figure 3B:
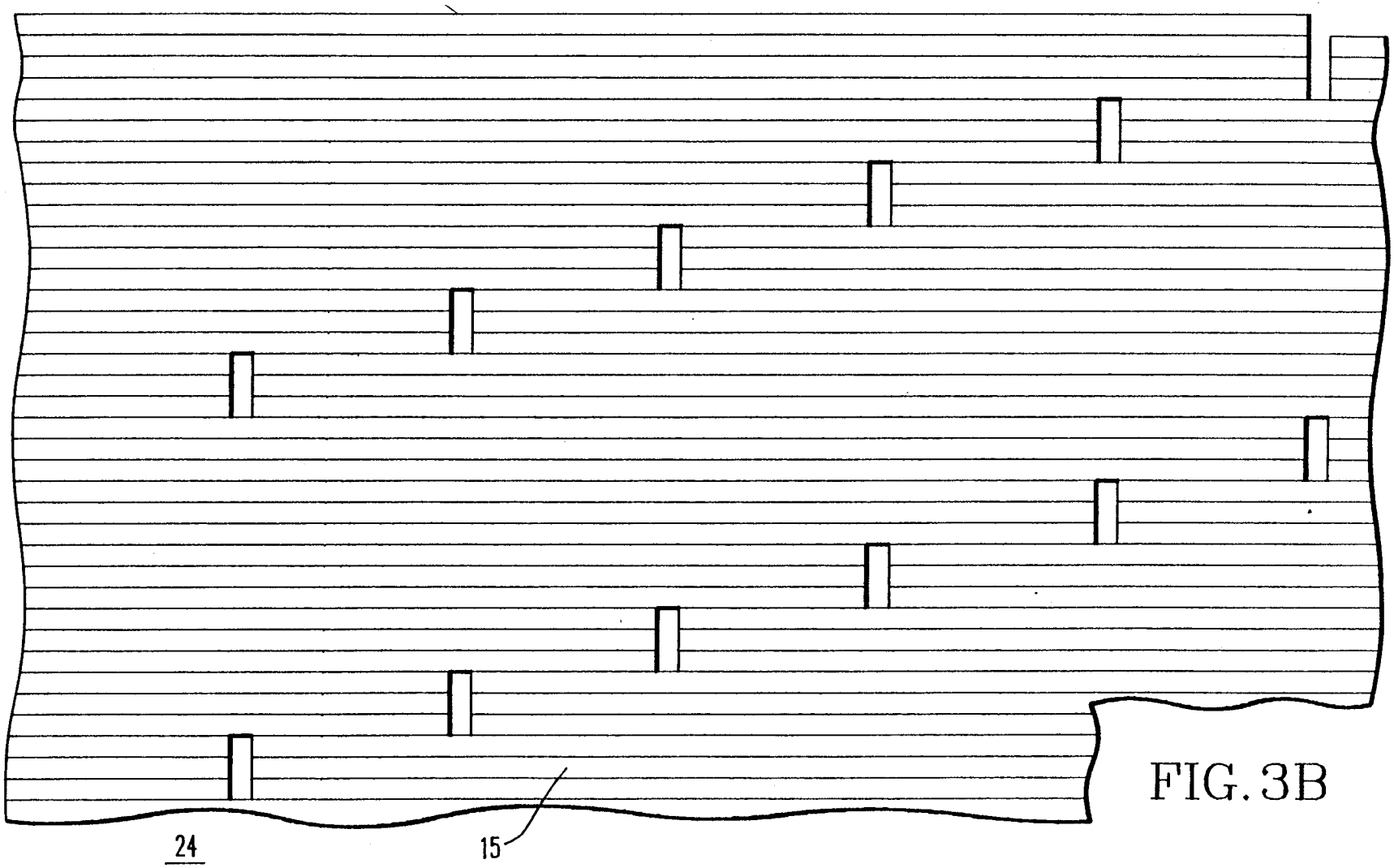
Figure 4:
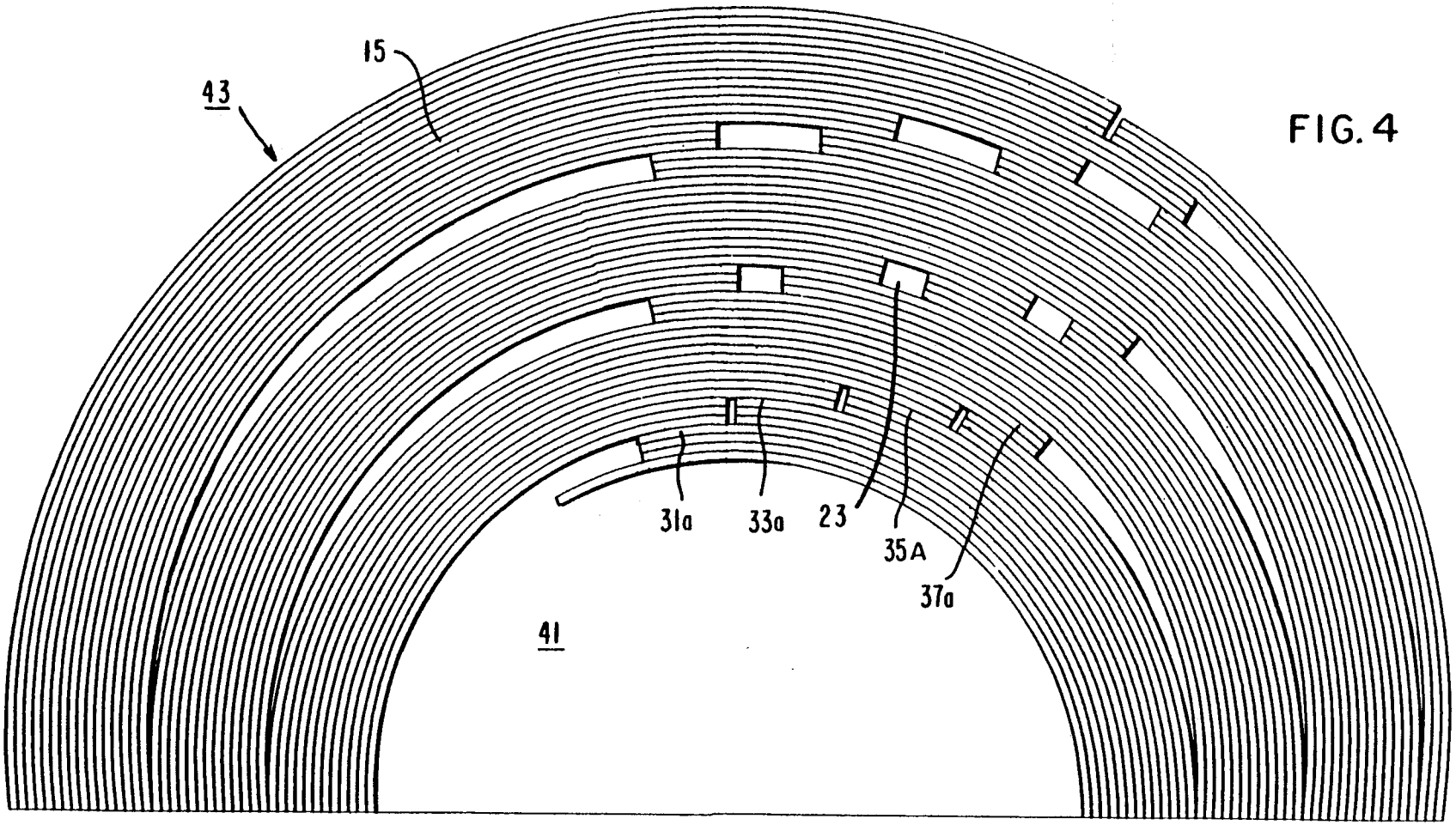
FIG. 4 is a fragmentary view in end elevation, generally diagrammatic, showing the mandrel of smaller perimeter used in the practice of this invention with the strips, progressing out of the initial spiral structure, wrapped on its outer surface, overlapped and abutted in accordance with the invention.
Figure 5A:
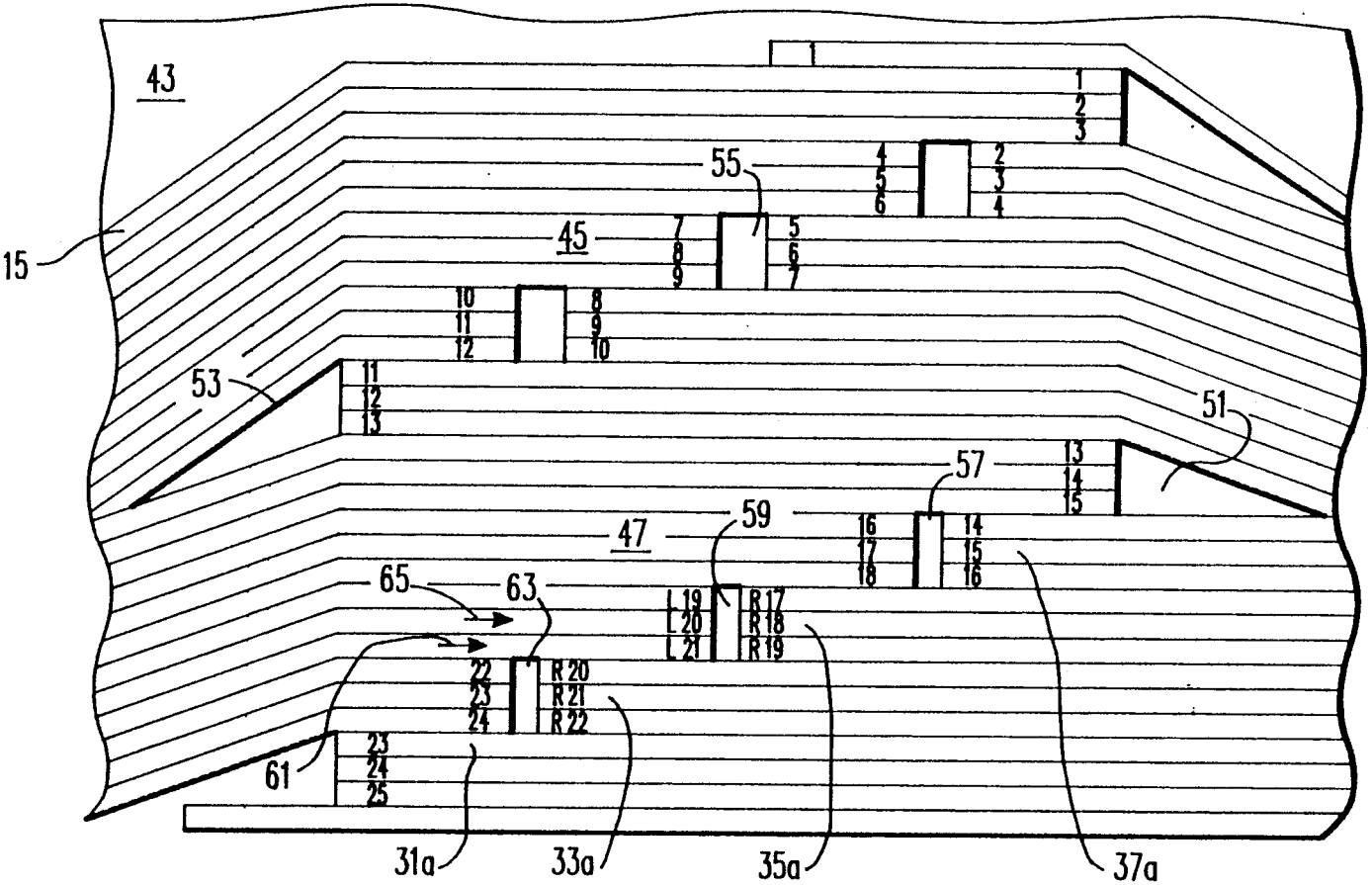
FIGS. 5A and 5B together constitute a diagrammatic view in end elevation, enlarged, showing a portion of the spiral structure shown in FIG. 4.
Figure 5B:
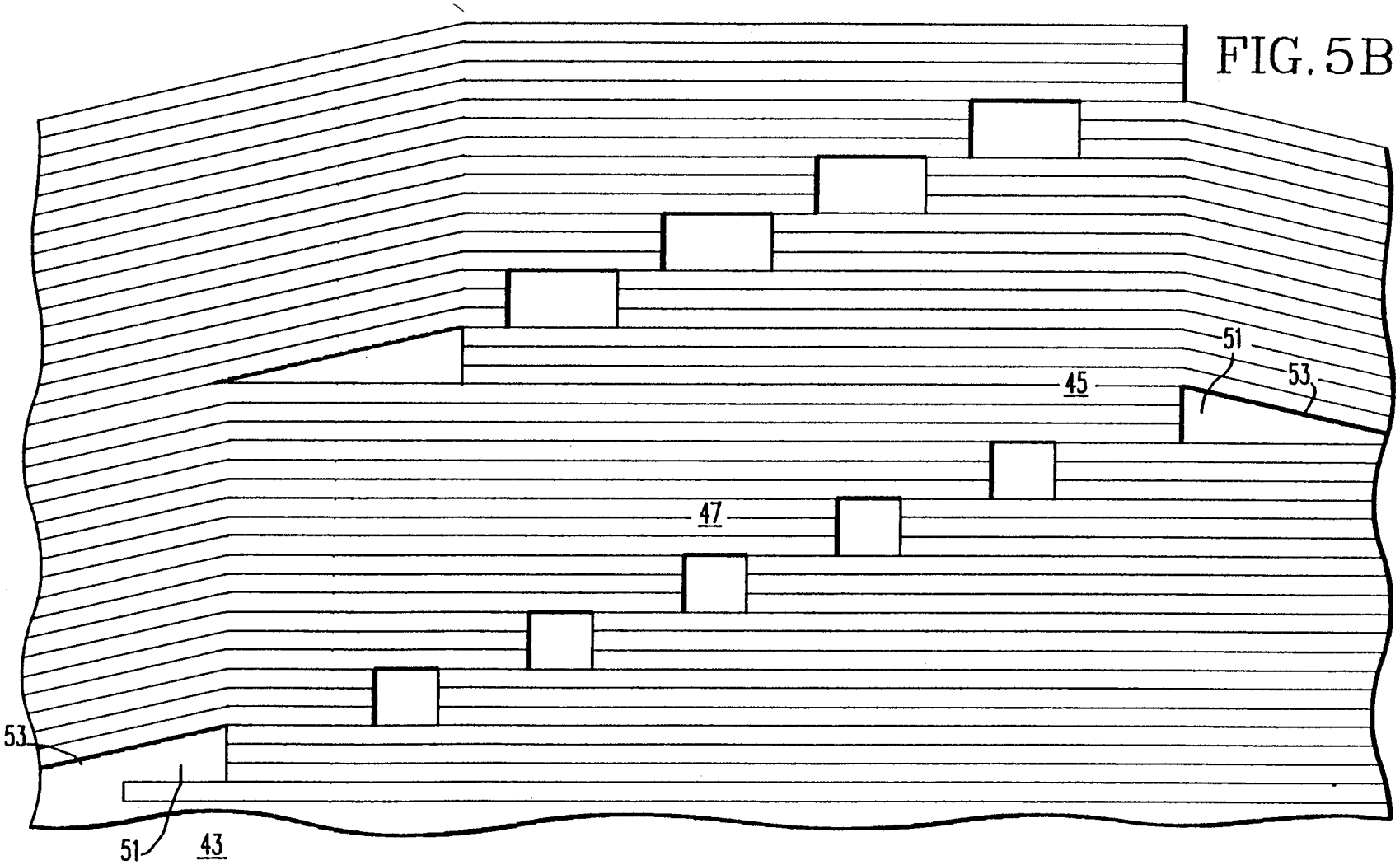

The further processing in the practice of this invention, of the cut spiral structures 13I or 130, the intermediate product, will now be described with reference to FIG. 4. FIG. 4 shows a mandrel 41 having a smaller perimeter than the mandrel 11. The strips such as 31*a*, 33*a*, 35*a*, 37*a* and the other like strips derived from structure 130 are wrapped on the mandrel 41 in overlapped relationship to form spiral structure 43 as shown in FIGS. 4, 5A and 5B. These views show the cuts 23 out of the spiral structure 43. The corresponding spiral 130, as wound on the mandrel 11, is shown in FIGS. 3A and 3B. In these views, typical displaceable strips corresponding to the strips shown in FIGS. 3A and 3B are identified as 31*a*, 33*a*, 35*a*, 37*a*. The strips 31*a* through 37*a*, etc. are wrapped around the mandrel beginning with the innermost strip to produce the structure 43. The relationship between the steps 45 and the groups 47 of the spiral structure 43 is shown in FIGS. 5A and 5B. In spiral structure 130 (FIG. 3A), ends on the right, near the left-hand corner of FIG. 3A, of turns 23, 24, 25 form a butt joint 49 with an end of turn 22 and the opposite ends on left of turns 23 and 24. In spiral structure 43 (FIG. 5A), the ends of turns 20, 21, 22 form a butt joint 63 with an end of turn 22 and the ends of turns 23 and 24. The other steps of the groups 45 and 47 are similarly shifted. Compare joint 23 (FIG. 3A) formed by abutting turns 4, 5, 6 and 5, 6, 7 and joint 55 (FIG. 5A) abutting turns 7, 8, 9 and 5, 6, 7. Because the mandrel 41 is of smaller perimeter than mandrel 11, turns 2, 3; 5, 6; 8, 9; 11, 12; 14, 15; 17, 18; 20, 21; (FIG. 5) are overlapped. The spiral structure shown in FIGS. 4, 5A and 5B is a product in accordance with this invention which is used to make a core and a transformer in the practice of this invention.

In the practice of this invention, the perimeters of the mandrel 11 (FIG. 1) and 41 (FIG. 4) are governed by the dimensions of the core (52, FIG. 7) which is made from the product. Typically, the core is a rectangular structure having a rectangular window (70, FIG. 7). The perimeters of the mandrel are based on the perimeter of the frame bounding the core window, i.e., from the inner diameter of the core.

Typically, if the inner perimeter of the core 52, (FIG. 7) is 24.0 inches, the corresponding outside perimeter of the smaller mandrel 41 for producing this core is 24.0 inches and if it is a circular cylinder, its diameter is 7.65 inches. Typically, if the over lapping at the outer surface of the mandrel 41, e.g., turns 23, 24 or 20, 21 (FIG. 5A) is 0.5-inch, the inner perimeter of the spiral structure from which the core is produced and the perimeter of the outer surface of the larger mandrel 11 is then 24.5 inches and if it is circular, the diameter is 7.8 inches. The overlap decreases as the lapping turns progress outwardly on the spiral structure 43.

As can be seen by comparing FIGS. 3A and 3B, and 5A and 5B, at any transition between an inner group and the immediate next outer group, the outer group is superimposed on the inner group, creating triangular voids 51. The boundary of a void 51 has a long side formed by the bounding turn 53 of the superimposed group. Since the additional lengths of the turn 53 are deducted from the width of the gaps at the butt joints, the gaps have greater width as the groups and gaps progress outwardly along the structure 43. With reference to FIGS. 5A and 5B, the group 47 including turns 1 through 13 is superimposed on the group including turns 13 through 25; the turn 13 is common to the inner group 47 and the outer group. The overlapping of turns 13 through 25 produces voids 51 having the longer boundaries formed by turns 53. The gaps 55 of the superimposed other group are wider than the gaps 57 of the inner group.

The product which is produced as disclosed above is converted into a core 52 shown in FIG. 7 by the process described in Valencic with reference to FIGS. 1 through 22. The abutted cuts 54 are in the yoke 56. Since the cuts 54 are into the spiral in core 52, FIGS. 5A and 5B can be viewed as an enlarged view in end elevation of a section of the yoke 56. The yoke 56 is opened at the cuts 54 as taught by Valencic. The arms consisting of the open halves 58 of the yoke 56 and the legs 60 of the core are shown in broken lines in FIG. 7. A transformer 62 as shown in FIG. 8 is completed by telescoping the coils 64 on the arms 58–60 and reclosing the yoke 56. These steps are described in Valencic.

The advantage of this invention will now be described by comparing the magnetic flux flow in a core with reference to FIG. 5A with the corresponding flow with reference to FIG. 3A. Attention is directed to gap 59 in FIG. 5A where the turns 17, 18, 19 and the turns 19, 20 and 21 are abutted. The left-hand branches of the turns are identified by the letter L and the right-hand branches by letter R. It is assumed that the flux flows from left to right. Flux crowding occurs only when flux from a turn penetrates into another turn and flows along with the normal flux in the latter turn. Thus the flux in turn L21, represented by arrow 61, passes over gap 63 and reaches R21 without crowding by flowing through R20. R20 is empty in the region that the flux flows through. Flux in turn L20, represented by arrow 65, flows into R20 through L21 in a similar manner.

Now, consider the diversion of flux about gap 59 for flux flowing left to right. Flux flowing in L19 has alternate paths in returning to R19; one path: L19-L18-R17-R18-R19, crossing four interfaces between turns and crowding the flux in L18; the alternate path L19-L20-L21-R20-R19, crossing four interfaces and crowding the flux in R20. Flux flowing in L20 returns to R20 in one path: L20-L21-R20, two interfaces and no crowding. Flux flowing in L21 returns to R21 in one path: L21-R20-R21; two interfaces and no crowding.

Now, with reference to FIG. 3A, consider the diversion of the flux about gap 71 in spiral structure 24 produced by winding the web 15 on the larger mandrel. This is essentially the prior art structure disclosed in Grimes '630. Gap 71 is a butt joint of turns L19, L20, L21 and R20, R21, R22. Flux 72, left-to-right, in L19 gets back to R19 by following in the path: L19-L18-R20-R19, crossing three interfaces and crowding the flux in L18 and L20. Flux 74 in L20 gets back to R20 by following path: L20-L19-L18-R20, crossing three interfaces and crowding the flux in L18. Flux 76 in L21 gets back to R21 in path: L21-R23-R22-R21, crossing three interfaces and crowding the flux in R23.

The above description of flux flow reveals that flux crowding in the core of this invention occurs only in the flow from L19 to R19 and the crowding is divided between L18 and R20, while crowding in the prior art structure occurs in four turns, L18 and L20, L18 and R23. As to the tendency to saturate, this invention is markedly superior to the prior art.

With the aid of FIGS. 2A and 6A, the core (52, FIG. 7), in which the cuts are into the spiral, will now be compared with the prior art. Attention is directed to the gap 81 of FIG. 6A, formed between the abutting turns L19, L20, L21 and the turns 23, 24, 25. Flux 82 in L19, left-to-right, flows to R19, bypassing gap 81, in the path: L19-R22-R21-R20-R19, crossing four interfaces without crowding. Flux 84 in L20 returns to R20 in path: L20-L19-R22-R21-R20, crossing four interfaces without crowding. Flux in L21 flows into R21 in path: L21-L20-L19-R22-R21, crossing four interfaces without crowding.

Compare the foregoing with the flow of flux from left-to-right at gap 83 in FIG. 2A formed by L19, L20, L21 and R20, R21, R22. Flux 86 in L19 reaches R19 in path: L19-R19, crossing one interface without crowding. Flux 88 in L20 reaches R20 in path: L20-L19-R20, crossing three interfaces and crowding along R19. Flux 90 in L21 reaches R21 in path: L21-L22-R21, crossing three interfaces and crowding in L22. Applicants' invention with the cuts into the spiral is not only superior to the prior art, but is also superior to applicants' invention with the cuts out of the spiral.

The superiority of the core (FIG. 7), according to this invention in which the cuts are into the spiral, over the core (FIGS. 5A, 5B) in which the cuts are out of the spiral, can be understood when it is realized that, in the practice of this invention, there are short turns which result from the overlapping of some of the turns. The crowding is produced by the flow of flux between the ends of the short turns, for example, L19 to R19 in FIG. 5A. In the core with the cuts into the spiral (FIGS. 6A, 6B), there is only one short turn per group, the turn 13 (FIG. 6A). In the core with the cuts out of the spiral, the number of short turns is equal to the number of steps cut into the spiral structure 13 wound on the larger mandrel 11 less one. With reference to FIG. 5A, the short turns are 16, 19, 22 in the lower group and 4, 7, 10 in the group just above the lower group. The number of short turns is three per group. The number of cuts in the structure 13 is four. In a typical actual situation in which there are 15 turns to a step and initially 7 steps per group, the core, according to this invention with the cuts into the spiral, has only one short turn per group, while the core in which the cuts are out of the spiral has 6 short turns per group.

Figure 9:
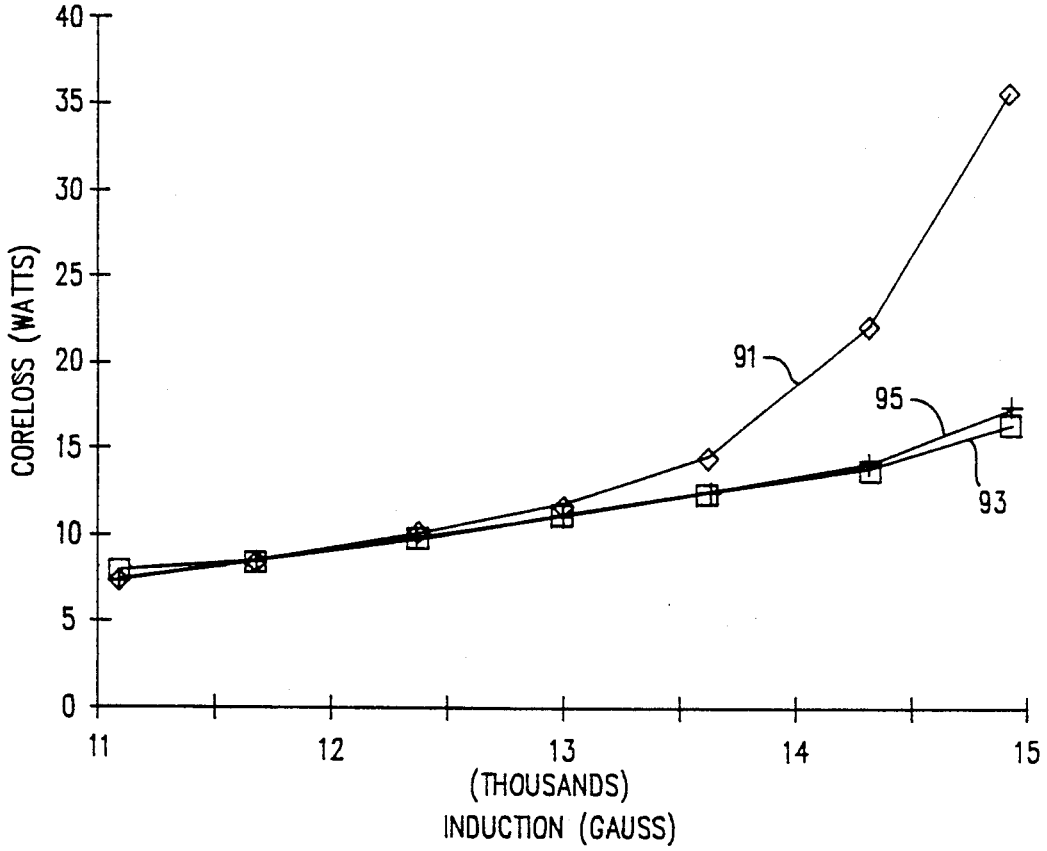
FIG. 9 is a graph based on measurements performed as a transformer made in accordance with this invention, showing the improvement achieved with this transformer.

FIG. 9 presents a comparison with respect to saturation between a prior art transformer and a transformer in accordance with this invention. The saturation is evaluated in terms of core loss power; the higher the core loss, the more the tendency to saturate. FIG. 9 is based on actual measurement of core loss as a function of induction for a prior art transformer and for two transformers in accordance with this invention. Induction is plotted horizontally in thousands of Gauss and core loss in watts is plotted vertically. Curve 91 is the plot for the prior art and curves 93 and 95 for the invention. It is seen that, beginning about 13,000 Gauss, the core loss for the prior art transformer increases at a substantially higher rate than the core loss for the invention.

While preferred practice of this invention has been disclosed herein, many modifications thereof are feasible. This invention is not to be restricted, except insofar as is necessitated by the spirit of the prior art.

We claim:

1. The method of making a transformer having a core composed of a web of magnetizable material; the said method including: winding said web into a spiral structure on a first mandrel having a first perimeter, cutting a plurality of groups of steps in said structure, steps of each group being offset peripherally along said spiral structure and in depth in said structure thereby dividing said spiral structure into a plurality of separable strips, each strip constituting the turns forming a boundary of a step, separating said strips from said spiral structure, winding said separated strips on a second mandrel having a second perimeter shorter in length than said first perimeter thereby to produce a second spiral structure, certain of whose turns overlap with butt joints between confronting ends of the separated strips thereby providing a region of the spiral structure where it can be opened, opening the overlapped turns in said region to form an opened second spiral structure having legs, telescoping coil means on said legs, and reclosing said second laminated structure at said cut regions to form a transformer.

2. The method of claim 1 wherein the steps in each group outwardly to inwardly with respect to said spiral structure are offset in depth in the direction in which the spiral structure is wound.

3. The method of claim 1 wherein the steps of each group outwardly to inwardly with respect to said spiral structure are offset in depth in the direction opposite to the direction in which the spiral structure is wound.

4. The method of making a product composed of a web of magnetizable material for use in producing a core for a transformer; said method comprising: winding said web on a first mandrel having a first perimeter to form a first spiral structure, cutting groups of steps into said spiral structure, each step including at least one turn of said spiral structure, and the steps of each group being cut in a succession in which each step of each group is offset peripherally along said structure and in depth in said structure with respect to the steps succeeding and/or preceding said each step thereby producing a plurality of separable strips of turns, each strip constituting the turns bounding a step, separating said strips from said spiral structure, winding said separated strip on a second mandrel having a second perimeter shorter in length than said first perimeter to form a second spiral structure, and while so forming said second spiral structure overlapping contiguous steps of each group thereby to produce said product.

5. The method of claim 4 characterized by that the steps of each group are cut, outwardly to inwardly with respect to said spiral structure, into the spiral structure in the direction in which the spiral structure is wound.

6. The method of claim 4 characterized by that the steps of each group are cut, outwardly to inwardly with respect to said spiral structure, into the spiral structure in the direction opposite to the direction in which the spiral is wound.

7. The method of claim 4 wherein the number of steps of each group cut into the first spiral structure is decreased as the groups progress from the outer surface of said first spiral structure inwardly.

8. The method of claim 4 wherein before the groups of cuts are cut into the first spiral structure, the first spiral structure is removed from the first mandrel and positioned to have the groups of steps cut therein.

9. The method of making a product composed of a web of magnetizable material which product is to be fabricated into a core of a transformer; said method including:

(a) winding said web into a first spiral structure on a first mandrel having a first perimeter;

(b) cutting groups of steps into said spiral structure progressively from the outer surface of said spiral structure to the inner surface of said spiral structure, each step including at least one turn of said spiral structure and the steps of each group being in a succession extending peripherally along and in depth into said spiral structure, each step offset peripherally and in depth with respect to steps succeeding and/or preceding said each step thereby to produce a plurality of separable strips of the turns of said spiral structure; each strip constituting the turns bounding a step;

(c) separating said strips from said spiral structure;

(d) wrapping said separated strips on a second mandrel having a second perimeter shorter than said first perimeter, into a second spiral structure, the innermost strip of the innermost group being wrapped around the outer surface of said second mandrel and each strip of each group being wrapped around the immediately preceding strip at the inner group and the innermost strip of each group being wrapped around the outermost strip of the immediately preceding inner group, thereby to form a second spiral structure; and (e) in wrapping said strips of said groups on said second mandrel, wrapping the assemblies so that the outer end of each strip overlaps the inner end of said each strip, and the inner end of said each strip forms a butt joint with the outer end of the immediately preceding inner assembly.

10. The method of claim 9 wherein the steps of each group are cut into the first spiral structure so that said steps progress peripherally in succession from the outermost step to the innermost step in the same direction as the direction in which the turns are wound on the first mandrel.

11. The method of claim 9 wherein the steps of each group are cut into the first spiral structure so that said steps progress peripherally in succession from the outermost step to the innermost step opposite to the direction in which the turns are wound on the first mandrel.

12. The method of claim 9 wherein the number of steps in certain groups is less than the number of steps in groups inwardly of said certain groups.

13. The method of claim 12 wherein before a plurality of groups of steps are cut into the spiral structure, the spiral structure is removed from the first mandrel and positioned for the cutting of the plurality of steps.

14. The method of claim 8 wherein before the groups of cuts are cut into the first spiral structure, the first spiral structure is removed from the first mandrel and positioned to have the groups of steps cut therein.

* * * * *